US011583723B2

(12) United States Patent
Essex et al.

(10) Patent No.: US 11,583,723 B2
(45) Date of Patent: Feb. 21, 2023

(54) PORTABLE EXERCISE SUPPORT PLATFORM

(71) Applicants: Robert Lee Essex, Battle Creek, MI (US); Teri Seedorff, Burlington, MI (US)

(72) Inventors: Robert Lee Essex, Battle Creek, MI (US); Teri Seedorff, Burlington, MI (US)

( * ) Notice: Subject to any disclaimer, the term of this patent is extended or adjusted under 35 U.S.C. 154(b) by 0 days.

(21) Appl. No.: 16/814,980

(22) Filed: Mar. 10, 2020

(65) Prior Publication Data

US 2020/0282257 A1 Sep. 10, 2020

Related U.S. Application Data

(60) Provisional application No. 62/816,176, filed on Mar. 10, 2019.

(51) Int. Cl.
*A63B 21/00* (2006.01)
*A63B 21/16* (2006.01)

(52) U.S. Cl.
CPC ..... *A63B 21/4037* (2015.10); *A63B 21/1672* (2015.10); *A63B 2210/50* (2013.01)

(58) Field of Classification Search
CPC ..... A63B 21/4037; A63B 21/00047; A63B 21/1672; A63B 21/4027; A63B 21/4033; A63B 2210/50; A63B 2210/58; A63B 71/0036; A63B 71/0054; A63B 2071/009; A63B 2209/00; A63B 2209/08; A63B 2209/10; A63B 6/00; A63B 21/4039; A63B 2071/0063; A63B 2208/0238; A63B 2208/0242; A63B 2208/0247; A63B 2208/0252; A63B 2208/0257; A63B 2023/006; A63B 21/16; A63B 2225/09

See application file for complete search history.

(56) References Cited

U.S. PATENT DOCUMENTS 3,284,819 A * 11/1966 Nissen ..... A47C 27/001 404/35
3,319,273 A * 5/1967 Solin ..... A63B 6/00 473/29
4,350,721 A * 9/1982 Nagase ..... A44B 19/34 160/DIG. 18
4,911,440 A * 3/1990 Hyman ..... A63B 22/16 482/146
4,985,952 A * 1/1991 Edelson ..... A47C 27/001 5/12.2
5,066,001 A * 11/1991 Wilkinson ..... A63B 21/4037 482/52
5,246,401 A * 9/1993 Boatwright ..... A63G 21/00 280/18

(Continued)

*Primary Examiner* — Gary D Urbiel Goldner

(57) ABSTRACT

Embodiments of the present invention comprise a portable exercise platform allowing users to exercise on a soft substrate. The portable exercise platform comprises at least three panels wherein the at least three panels are connected by at least one hinging device allowing the at least three panels to lay flat or fold into proximity to each other. The at least three panels are configured with a top surface and bottom surface such that the top surface is configured to support a user and the bottom surface is configured to contact the soft substrate when the portable exercise platform is lying flat.

11 Claims, 9 Drawing Sheets

(56) References Cited

U.S. PATENT DOCUMENTS 5,265,292 A * 11/1993 Underell ..... A47C 4/52 5/419
5,417,636 A * 5/1995 Havens ..... A63B 21/0552 482/145
6,062,930 A * 5/2000 Smith ..... A47C 15/006 441/125
D430,627 S * 9/2000 Bergman ..... D6/583
6,135,895 A * 10/2000 Estivo ..... A63B 69/3661 473/278
6,233,766 B1 * 5/2001 Ohman ..... A61G 1/01 5/722
6,618,883 B2 * 9/2003 Angland ..... A47C 17/04 5/659
7,207,932 B1 * 4/2007 Dean ..... A63B 23/0211 482/148
7,591,763 B1 * 9/2009 Fucci ..... A63B 21/4013 482/52
8,025,614 B2 * 9/2011 Newburger ..... A63B 21/065 482/130
8,029,426 B2 * 10/2011 Sohn ..... A63B 21/4037 482/145
8,307,600 B2 * 11/2012 Heartsfield ..... A63B 6/00 52/177
D685,593 S * 7/2013 Boyer ..... A47C 15/006 D6/592
D701,062 S * 3/2014 Kinsella ..... A63B 21/0552 D6/582
8,734,308 B1 * 5/2014 Joslin ..... A63B 22/18 482/79
8,887,327 B2 * 11/2014 Davis, Jr. ..... A61G 7/1026 5/81.1 HS
8,899,677 B2 * 12/2014 Hurlburt ..... A47C 13/00 297/452.17
D730,456 S * 5/2015 Mahoney ..... A63B 22/16 D21/671
10,238,939 B2 * 3/2019 Bair ..... B63B 34/565
10,315,086 B1 * 6/2019 Johnson ..... A63B 69/0013
2005/0130804 A1 * 6/2005 Hall ..... A63B 5/11 482/28
2008/0058165 A1 * 3/2008 Schletti ..... A63B 21/4037 482/23
2009/0260157 A1 * 10/2009 Gere ..... A45C 9/00 5/417
2013/0090216 A1 * 4/2013 Jackson ..... A63B 21/0442 482/52
2014/0287894 A1 * 9/2014 Austin ..... A63B 21/4029 482/142
2018/0280752 A1 * 10/2018 Duval ..... A63B 23/0458

* cited by examiner

SECTION A-A

DETAIL B

PORTABLE EXERCISE SUPPORT PLATFORM

CROSS-REFERENCE TO RELATED APPLICATIONS

This application claims the benefit of U.S. Provisional Application 62/816,176, filed Mar. 10, 2019.

BACKGROUND

Field of the Invention

This invention relates to exercise apparatuses, and more particularly, to embodiments of exercise apparatuses, namely exercise support platforms, that enable users to exercise safely, conveniently, and effectively on an easily accessible surface such as a bed, couch, or typical box spring and mattress, because many individuals have trouble getting down to and/or up from the floor for exercises. In settings outside of a therapy clinic, these individuals may not have access to, or the space for, an elevated plinth or treatment table. In further embodiments, said apparatuses are highly portable and convenient to deploy, use and store.

Application and Purpose

Exercise is widely accepted for its health benefits. Exercise is increasingly recognized in the scientific literature as a potent tool toward promoting health, managing, alleviating or correcting many disease processes and optimizing mobility and function. Physical therapists, physicians, and other healthcare providers often prescribe home-based exercise routines for a variety of diagnoses and impairments. Virtually every physical therapy patient is prescribed a home exercise program, and many of those programs require the patient or individual to position themselves in a supine, prone, side-lying or quadruped position.

Individuals with various mobility impairments often have difficulty performing exercise routines at home or in a range of clinical settings for one simple reason: they cannot get down on the floor to exercise and/or the bed/mattress is too soft. Exercise on the too-soft mattress is technically ineffective or potentially dangerous, and getting to the floor is either impossible due to comorbidities or other health-related impairments, presents a safety issue, or is simply "too much work," such that it serves as a barrier to compliance with the prescribed exercise program. These mobility impairments are commonplace in the expanding geriatric population but are certainly not limited to that demographic.

SUMMARY OF THE INVENTION

Figure 1:
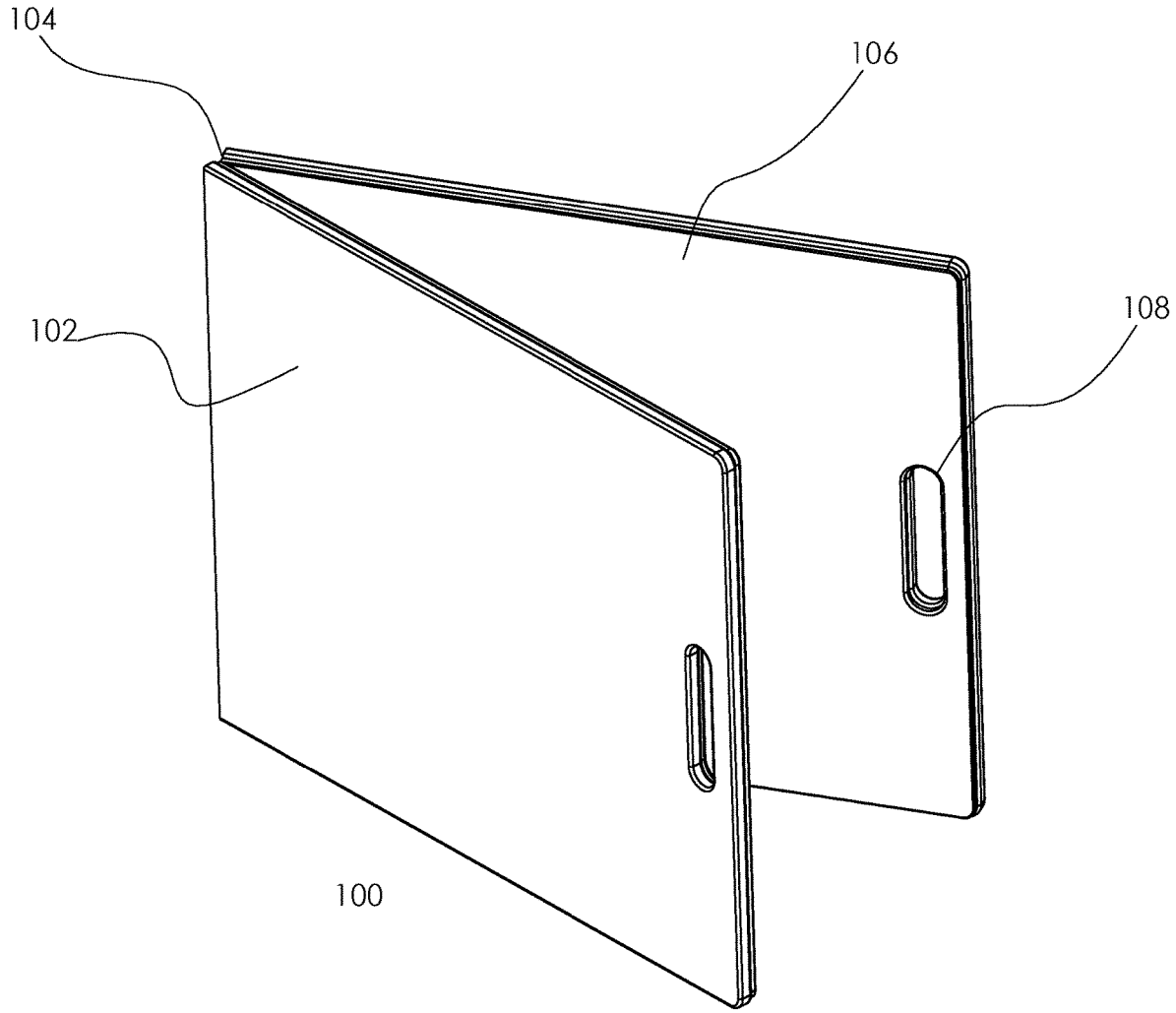
FIG. 1 depicts a partially unfolded double-panel example embodiment of the present invention.

Embodiments of the present invention may include a portable exercise platform allowing users to exercise on hard or soft substrates comprising two or more panels wherein said at least two panels are connected at one end by at least one hinging device allowing said panels to lay flat or fold into proximity to each other and said panels are configured with a top and bottom surface such that the top surface is designed to support a user and the bottom surface is designed to contact the substrate when the platform is lying flat.

Other embodiments may include a portable exercise platform comprising two panels. Still others may comprise three panels, wherein each panel is configured with two panels connected to a central panel with hinging devices. In further embodiments, at least one of said at least two panels further comprises a sliding support engaged with a recess that prevents folding of the panels when the platform is lying flat and in use. In further embodiments, the two panels connected to the central panel each further comprise a sliding support engaged with a recess that prevents folding of the panels when the platform is lying flat and in use.

In other embodiments, the top surface of at least one of said at least two panels further comprises padding, upholstery or both. In yet others, the bottom surface of at least one of said at least two panels is textured to avoid movement over the substrate when lying flat and in use. Further embodiments further comprising at least one handle attached to at least one of said at least two panels. In some embodiments, at least one of said at least two panels further comprises a hole configured to serve as a handle.

Some embodiments further comprise at least two hinging devices. Some further comprising a locking pin preventing sliding support from over-extension. In some embodiments, the at least one hinge device is covered with padding and/or upholstery to protect and add comfort to the user while in use.

Some aspects of the present invention include a method of manufacture of a portable exercise platform, comprising assembling two or more panels wherein said at least two panels are connected at one end by at least one hinging device allowing said panels to lay flat or fold into proximity to each other and said panels are configured with a top and bottom surface such that the top surface is designed to support a user and the bottom surface is designed to contact the substrate when the platform is lying flat.

In other aspects of the method of manufacture, said two or more panels comprises three panels, wherein each panel is configured with two panels connected to a central panel with hinging devices. In others, at least one of said at least two panels further comprises a sliding support engaged with a recess that prevents folding of the panels when the platform is lying flat and in use.

Some aspects of the present invention include a method of using a portable exercise platform comprising two or more panels wherein said at least two panels are connected at one end by at least one hinging device allowing said panels to lay flat or fold into proximity to each other and said panels are configured with a top and bottom surface such that the top surface is designed to support a user and the bottom surface is designed to contact the substrate when the platform is lying flat, comprising unfolding said platform to lie flat.

Other methods further comprising placing said platform on a surface prior to exercise. Still other aspects further comprising folding said platform such that said two or more panels are in close proximity to each other.

DESCRIPTION OF THE INVENTION

Before any embodiments or aspects of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

The following discussion is presented to enable a person skilled in the art to make and use embodiments and/or aspects of the invention. Various modifications to the illustrated embodiments will be readily apparent to those skilled in the art, and the generic principles herein can be applied to other embodiments and aspects without departing from embodiments of the invention. Thus, embodiments of the invention are not intended to be limited to embodiments or aspects shown or described but are to be accorded the widest scope consistent with the principles and features disclosed herein. The following detailed description is to be read with reference to the figures. The figures, which are not necessarily to scale, depict selected embodiments and are not intended to limit the scope of embodiments of the invention. Skilled artisans will recognize the examples provided herein have many useful alternatives that fall within the scope of embodiments of the invention.

While the invention has been described in connection with a preferred embodiment, it is not intended to limit the scope of the invention to a particular form, materials or dimensions set forth here, rather, it is intended to cover such alternatives, modifications, and equivalents as may be included within the spirit and scope of the invention. In general, terms used in the specification, drawing, and claims shall be given their commonly used definition in the relevant arts. Where in conflict, the definitions provided below and elsewhere in the specification control.

Embodiments of the exercise apparatuses described herein termed are lightweight, supportive, mobile platforms intended to provide a safe and efficient surface to exercise. The platforms may be placed on a mattress, couch, or similar surfaces. This allows for effective exercise positioning and safe, easy access to the prescribed/desired positioning. Users will be able to position supine, prone, side-lying or quadruped for technically correct form while exercising.

The user may place an embodiment of the exercise apparatuses on the bed or more accessible surface, performs their exercise routine using the apparatus, and then may easily remove the apparatus to store it until the next use.

Typical Placement

Exercise apparatuses of the present invention may be in some embodiments be designed to be portable, easy to move and convenient to use and store. They are designed to be comfortable yet resist vertical displacement when placed on a softer surface such as a box spring and mattress or other types of mattresses as would be found in a personal residence, assisted living facility or nursing home. It may prove useful to healthcare providers working in those types of settings as well.

Further, some embodiments of the present invention provide support for physical exercise as well as anchoring means to help prevent the apparatus from slipping or displacement on the surface where it is placed.

While designed in many embodiments to be placed on a raised, soft surface such as a bed, other raised, harder and/or more supportive surfaces such as tables, benches and the like, or the floor are suitable for embodiments of the present invention. Some embodiments of the present invention include padding on the top and/or bottom surface and thus are suitable for comfortable use on a variety of surfaces.

Figure 2:
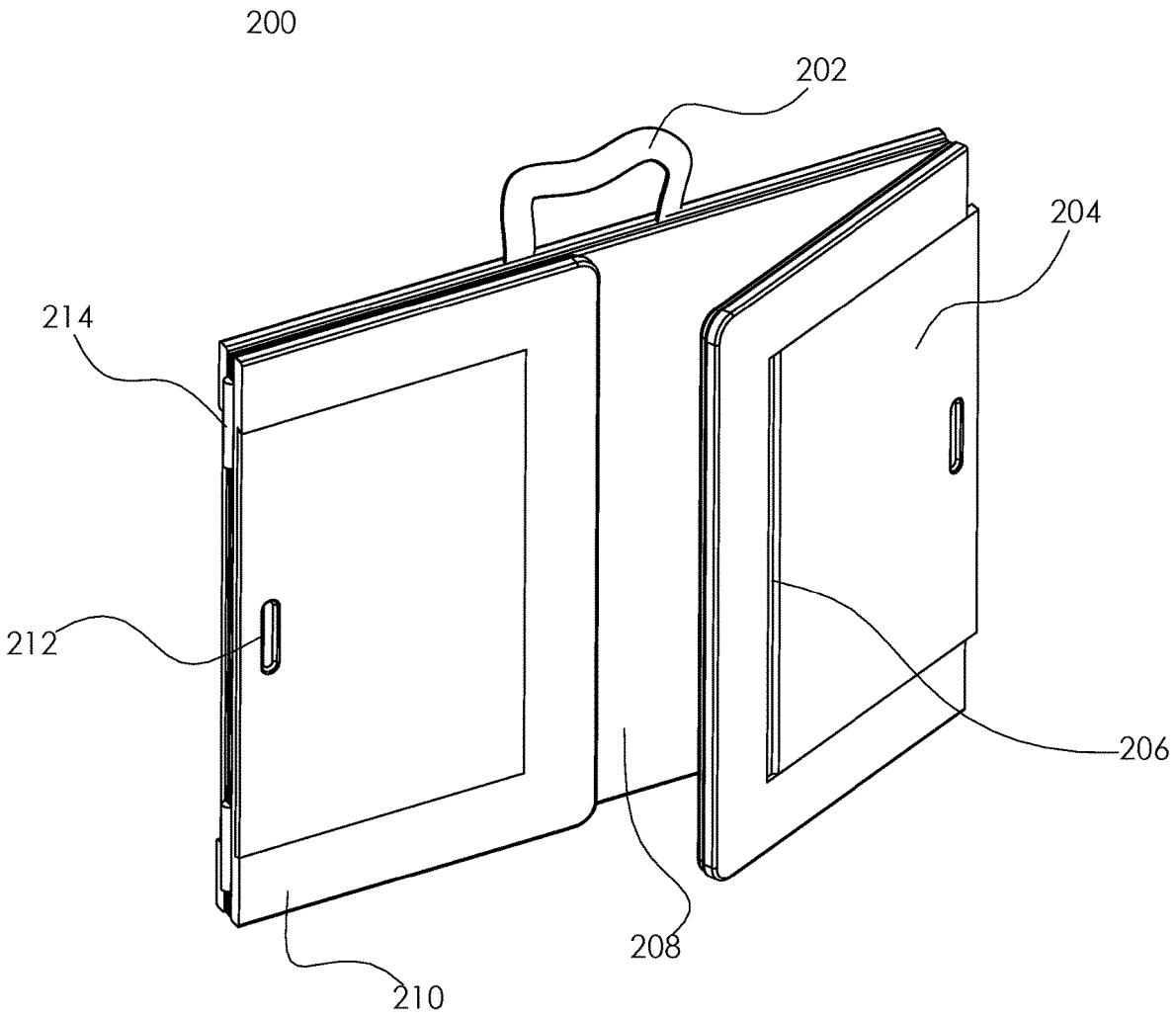
FIG. 2 depicts a partially unfolded triple-panel example embodiment of the present invention.

FIGS. 1 and 2 illustrate the differences between double and triple panel concepts. It may be noted that the design intent of the exercise apparatus of the present invention is not dependent on the number of panels, hinge placement, or closing configuration.

FIG. 1 depicts a partially unfolded double-panel example embodiment 100 of the present invention. The top surface (defined herein as the surface on which the user supports themselves while exercising on the unfolded apparatus) may be either the exterior surface 102 or interior surface 106 when the double-panel device is folded. The bottom surface is defined herein as the surface in contact with a substrate such as a mattress, bench, table, floor, etc. when the device is unfolded and ready for use. For purposes of example, here the exterior surface 102 is defined as the top surface, but other embodiments, the interior surface 106 may be the top surface that the user is contact with during use. In other embodiments, either surface may be used as the top surface, so that surfaces may be alternated to reduce wear, etc.

In many embodiments, whichever surface serves as the top surface is padded and/or upholstered to increase comfort to the user; in other embodiments, both top and bottom surfaces are padded and/or upholstered. Persons of skill in the art will recognize embodiments of the present invention may be padded and/or upholstered with any material(s) suitable for exercise applications, such as, for example, padding covered with a sanitary, moisture-wicking, moisture repelling, easily cleanable or sterilized upholstery material, such as PVC, vinyl, foam, TPE, EVA. Padding may be any suitable material such as foam, cotton or other fiber, natural or man-made batting, etc.

The top and/or bottom surfaces may be textured in some embodiments to increase grip and traction, both for the user on the top surface and for the device to the substrate.

In the example double-panel design shown in FIG. 1, the platform hinges at 104. As defined herein, "hinges" may include any devices or mechanisms to permanently attach two or more portions of a device while allowing them to pivot around each other. "Hinges" and "hinged" is also understood, unless specifically stated otherwise, methods of connecting and disconnecting portions of a device temporarily, such as hooks, latches and the like. Defining the device when completely unfolded as 0°, the range of motion of the hinges as described herein may be at or nearly 360° (i.e., can fold on itself in either rotational direction about the hinge such that either the top or bottom surface could be exterior 102 or interior surface 106) or at or nearly 0° (i.e. can only be in the completely unfolded or "straight" orientation or nearly so) or any value in between, but preferably at least 180° (can be folded in at least one rotational direction) or more. In embodiments of the present invention, the range of motion of the hinges is such that the device can be folded onto itself and unfolded to a nearly straight orientation for use. In some embodiments, one, two, three, or three or more separate hinged devices (e.g., hinges, hooks, latches and the like) may be used to comprise the hinging mechanism.

As shown in FIG. 1, apparatuses of the present invention may comprise one or more handles 108, to allow carrying and moving the device in any orientation. Such handles may be holes extending all the way through one or both panels of double-panel embodiments, or depressions not extending all the way through one or more panels of the device; such depressions are preferably located on the exterior surface 102 of the device for easier handling in all orientations. In other embodiments, the holes in each panel are configured to align with each other when the apparatus is folded, to allow for easier grip and movement.

In general, the device when unfolded has an overall rectangular shape, with a longer longitudinal axis and shorter cross axis to mirror the shape of the human body, but any other shape (curved, trapezoidal, square, etc.) may be used. The hinge 104 may be placed centrally to provide two panels of equal longitudinal length or off-center, thus creating two panels of unequal longitudinal length.

Embodiments of the present invention may have two, three, four or more than four panels depending on the application. As noted above, FIG. 2 depicts a partially unfolded triple-panel example embodiment 200 of the present invention.

The example embodiment 200 shows a strap-like handle 202 that can be used to carry the device. The strap may be rigid, flexible and/or foldable, in some embodiments at the point(s) of attachment to the rest of the device, to allow the handle to be placed within the device during storage to minimize damage to the handle. Persons of skill in the art will recognize that the handle may be made of any suitable material, such as rigid plastic, nylon strapping, leather, include padding, and the like. As persons of skill in the art will appreciate, other handles, such as the holes shown in FIG. 1 may also be used with a three-panel embodiment.

Embodiments of the invention, whether two, three or more paneled, may include a slidable support slider 204 on one or more panels 210. Slider 204 may slide back and forth in recess 206 on panel 210. Draw handles 212 may be present in some embodiments to aid in extending and retracting support slider 204. The support sliders 204 may be extended beyond the location of the hinge (i.e., 214) when the apparatus is unfolded flat to dig into or grip softer substrates, such as mattresses, to aid in keeping the apparatus in place and/or prevent the apparatus from closing/folding while exercising. The sliders 204 may be retracted fully into the recess 206 when operating the apparatus on a hard surface or where such extra support is not necessary, and also when the apparatus is folded for carrying or storage. Slider 204 and/or recess 206 may be configured, in some embodiments, to allow a certain or optimized range of extension of slider 204 but prevent or stop full removal of slider 204 from the rest of the apparatus when in use.

In the embodiment shown in FIG. 2, interior surface 208 becomes the top surface when the apparatus is deployed and unfolded for use, and the side with sliders 204, when unfolded, becomes the bottom surface. As noted above, in various embodiments, the top and/or bottom surfaces may be padded, upholstered, and textured to increase comfort, cleanability, safety and the like.

Two or more hinges 214 may be present to permit unfolding and folding. Similar to the embodiment described above for FIG. 1, one or more hinge devices may be present on each hinge 214, permitting a range to rotational movement in various embodiments.

Figure 3:
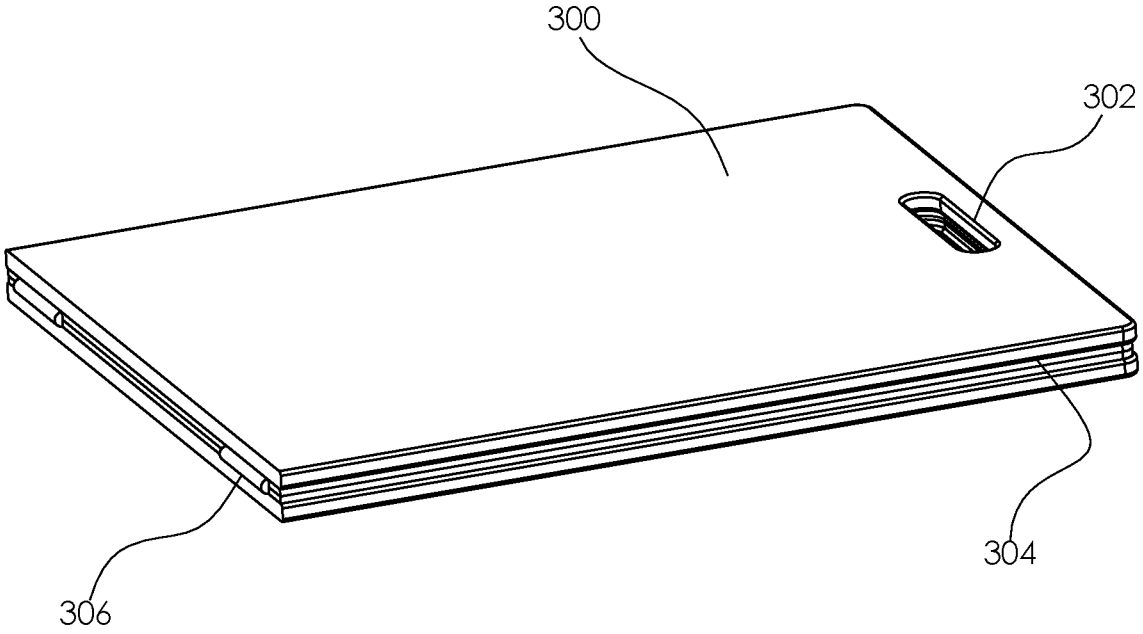
FIG. 3 depicts a folded double-panel example embodiment of the present invention.

FIG. 3 illustrates the compact configuration of a closed or folded example apparatus of the present invention. Shown here is a double-panel embodiment of the present invention. Exterior surface 300 may, in some embodiments, be the top surface (i.e., the surface on which the user supports themselves while exercising on the unfolded apparatus) in some embodiments; interior surface 304, may in some embodiments, be the top surface instead. As noted above, in some embodiments, both the interior or exterior surface may serve as the top surface.

Embodiments of the present invention may be hinged 306 and have handles (i.e., 302) to allow portability and compactness for storage when carrying or not in use.

Figure 4:
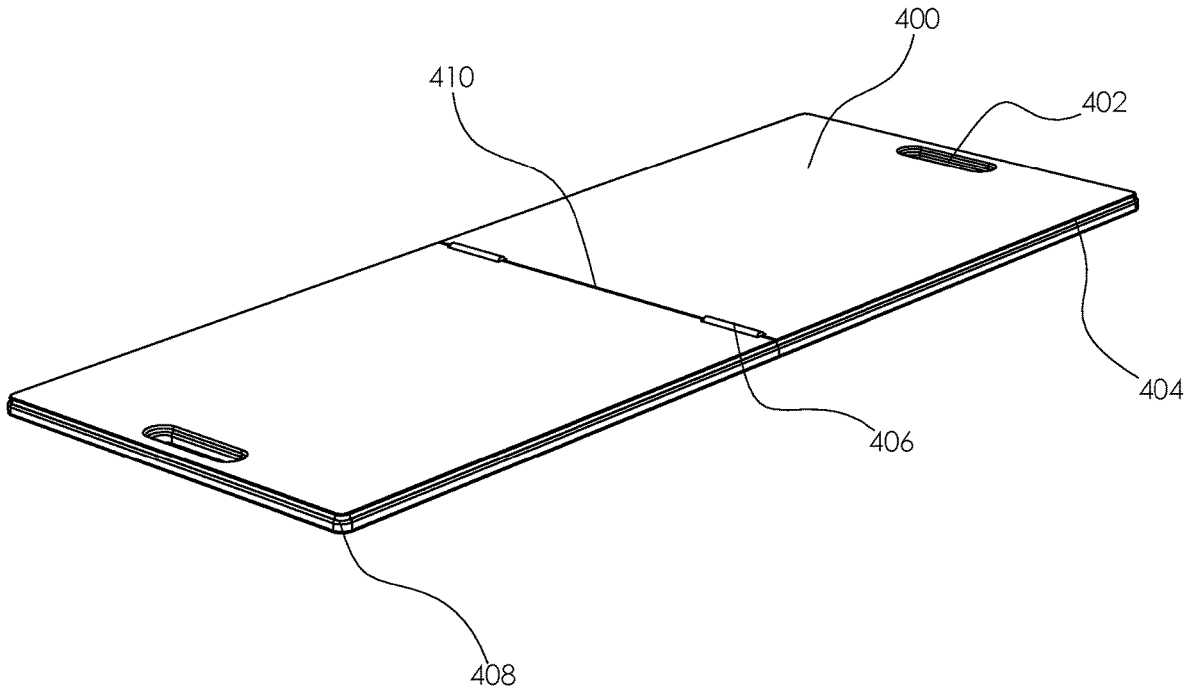
FIG. 4 depicts an unfolded double-panel example embodiment of the present invention; side/cross-sectional view of a vehicle gas inlet and gas cap showing an example embodiment of the present invention.

FIG. 4 illustrates the open configuration of the double panel geometry providing a support surface. Top surface 400 may be padded as described above, and have handles (i.e., 402) to allow portability and compactness for storage when carrying or not in use. Bottom surface 404 may be textured, padded or otherwise covered in a non-skid surface. In some embodiments, corners (i.e., 408) are beveled or otherwise rounded to avoid injury, reduce weight and prevent damage to the device. The hinge 410 may have one or more hinge devices (i.e., 406) to attach the panels and allow them to rotate the device to open/closed, folded/unfolded positions. In some embodiments, hinge devices 406 may be padded or otherwise protected for comfort during use. The hinge may be configured with padding, beveling, protective fabric and the like to reduce the chance of pinching or other injuries to the user during use.

Figure 5:
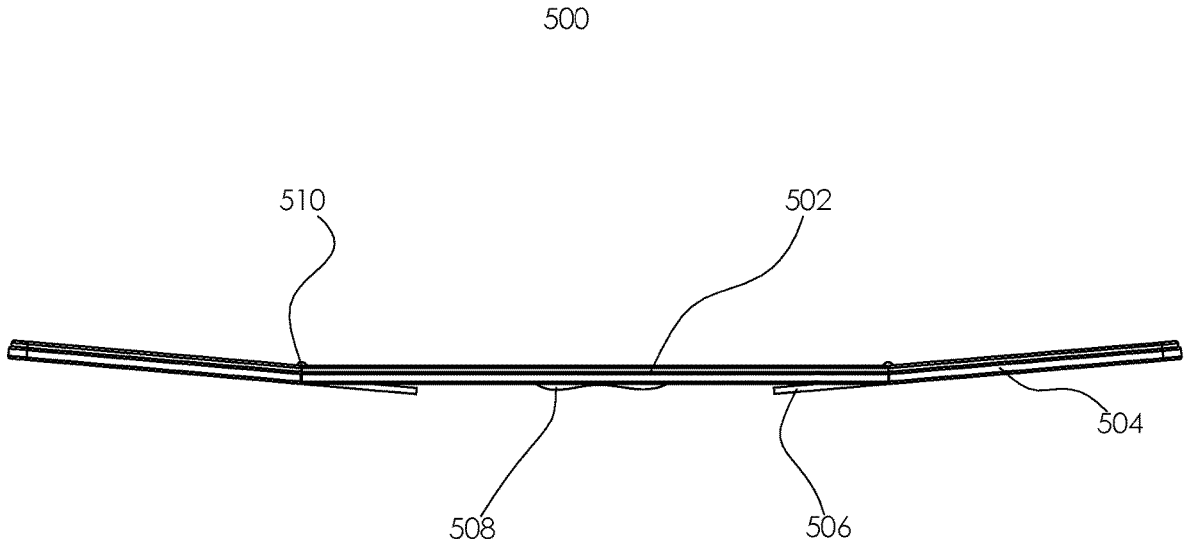
FIG. 5 depicts a side view of a nearly unfolded triple-panel example embodiment of the present invention.

FIG. 5 illustrates a side view of an open triple panel example embodiment 500 with support sliders that resist panel closing when embodiments of the present invention are being used. In embodiments where interior surface 502 is being used as the top surface, and exterior surface 508 as the bottom surface when unfolded and in use, the device may naturally attempt to fold up, e.g., raising outer panel 504, along the hinges (e.g., 510) in certain positions, especially of softer, "giving" surfaces such as mattresses, due to the shifting bodyweight of the user during movements and resultant depression of the surface. Extension of sliders 506 helps counteract this folding force and allow the embodiment to stay unfolded with the need for less force (i.e., gravity, the weight of the user) when being used, as well as help keep the device in place on soft surfaces.

Figure 6:
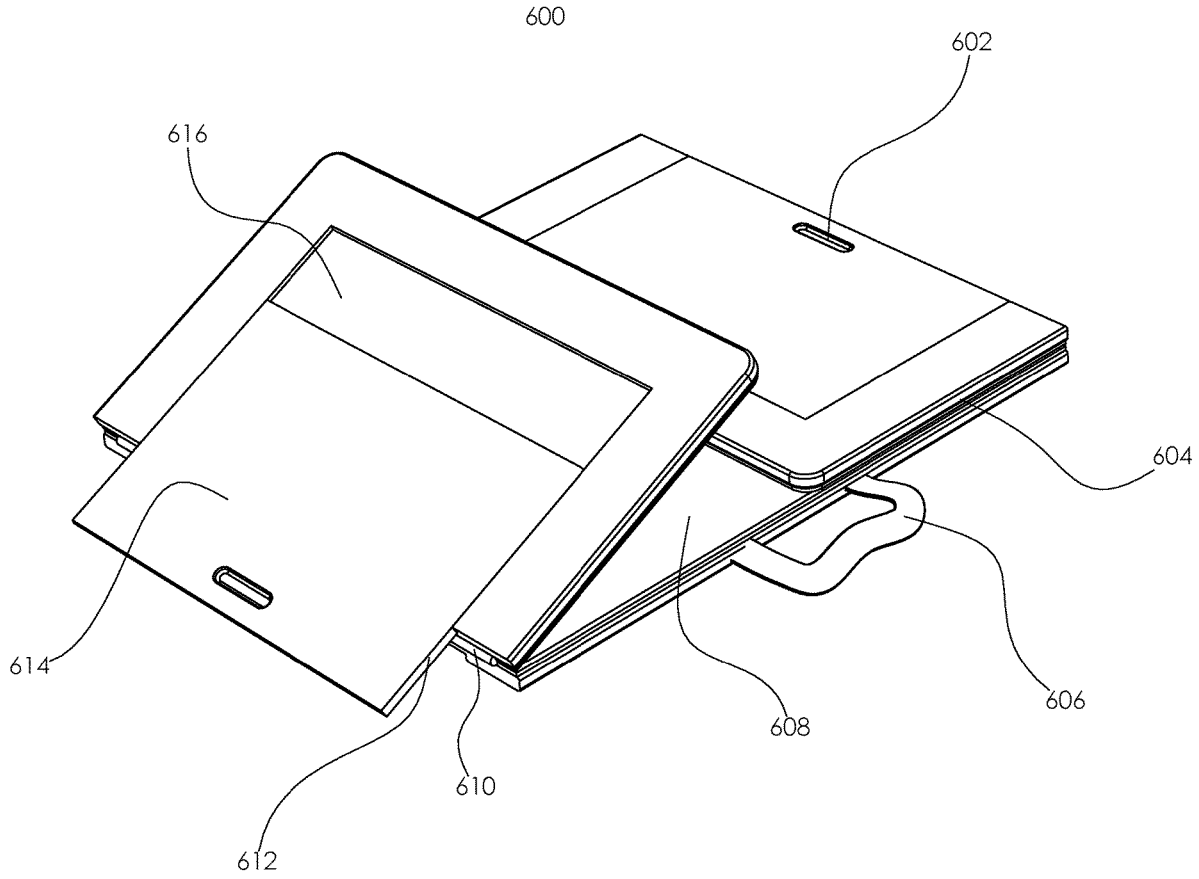
FIG. 6 depicts a partially unfolded triple-panel example embodiment of the present invention.

FIG. 6 illustrates an isometric view of a triple-panel example embodiment 600 of the present invention, similar to FIG. 2. Draw handles 602 may be present in some embodiments to aid in extending and retracting support slider (e.g., 614). The edge of exterior surface 604 may be beveled, covered with padding and/or upholstered to promote safety and sanitation. In some embodiments, a strap-like handle 606 that can be used to carry the device. As noted above, the strap may be rigid, flexible and/or foldable, in some embodiments at the point(s) of attachment to the rest of the device, to allow the handle to be placed within the device during storage to minimize damage to the handle.

Interior surface 608 in this example embodiment serves as the top surface when unfolded and may be padded and/or upholstered as described above. The apparatus in this three-panel example embodiment is hinged (e.g., 610) to minimize its overall footprint when folded for carrying or storage.

This embodiment also includes support slider 614, which in some embodiments may fit into recess 616 on exterior surface 604. The fit of slider 614 and recess 616 may be such, in some embodiments, to prevent the slider 614 from easily extending when not in use, such as when folded during storage or when being carried, or when extension is not desired when the apparatus is in use. Persons of skill in the art would recognize many different means of preventing over-extension or unwanted extension of slider 614, such as, for example, corresponding depressions and protrusions in the contacting surfaces of 614 and 616, that are fashioned to prevent further extension or require a certain amount of force for further extension. For instance, a series of depressions/protrusions may be present in some embodiment on one or more edges of slider (e.g., 612) to allow for step-wise deployment or extension of slider 614, i.e., a shorter or longer extension as needed for use; these may in some embodiments engage a series of corresponding depressions/protrusions on the edge of recess 616 to frictionally engage slider 614.

As noted above, the support sliders 614 may be extended beyond the location of the hinge (e.g., 610) when the apparatus is unfolded flat to dig into or grip softer substrates, such as mattresses, to aid in keeping the apparatus in place and/or prevent the apparatus from closing/folding while exercising.

Figure 7:
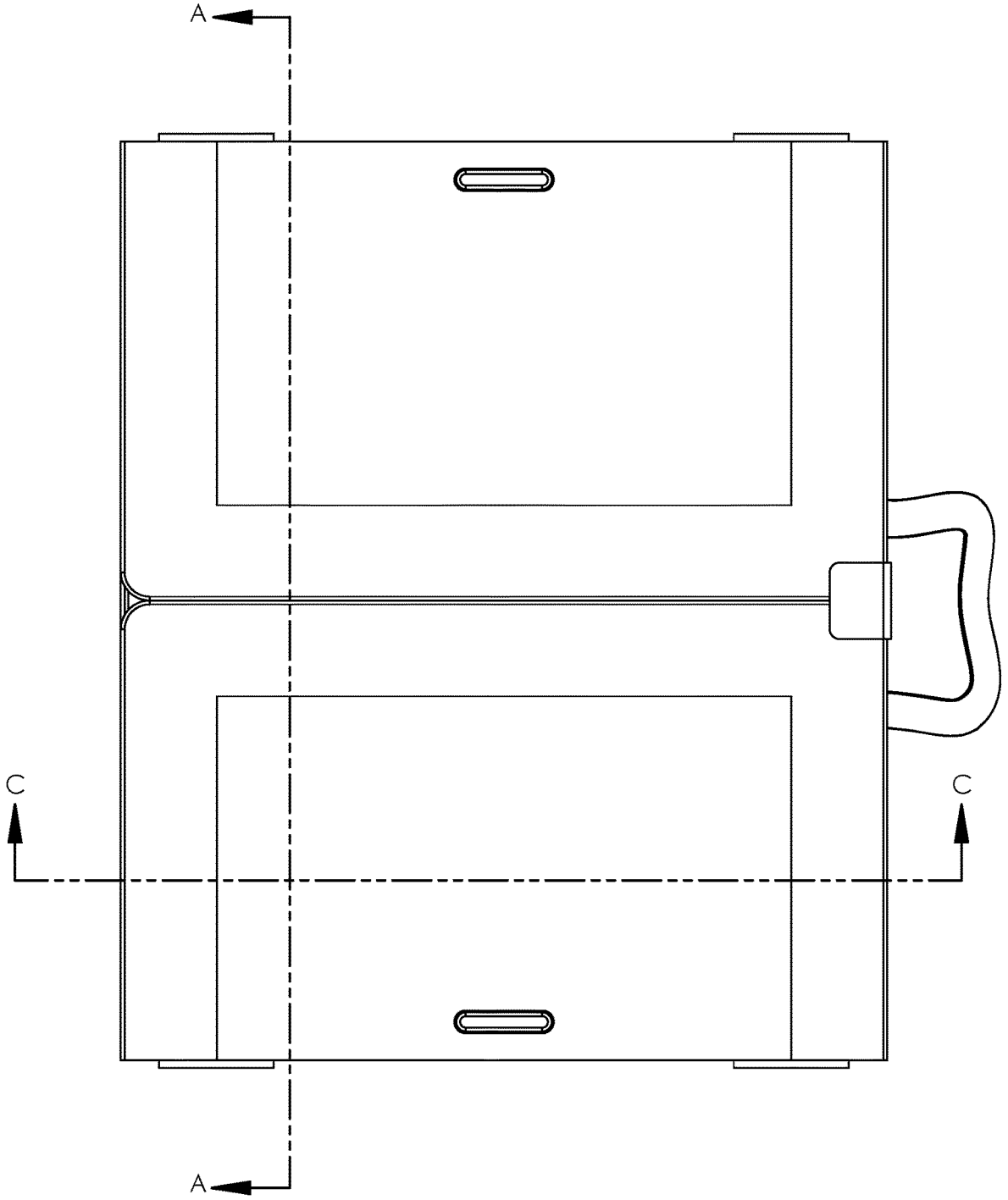
FIG. 7 depicts a folded triple-panel example embodiment of the present invention.
Figure 8:
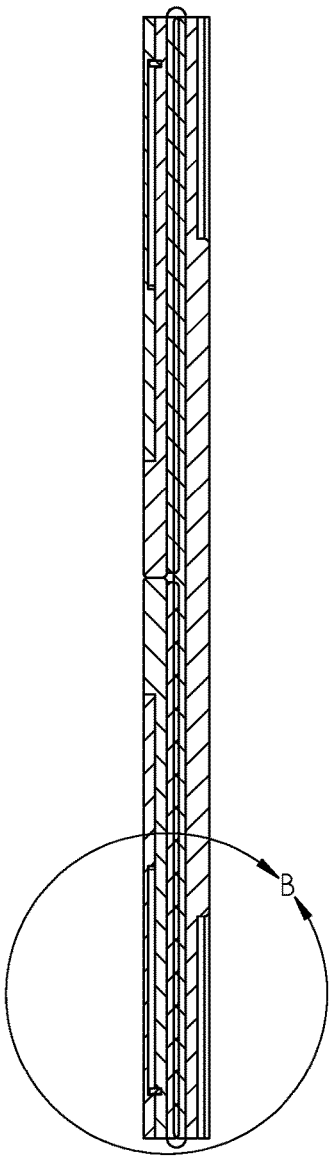
FIG. 8 is an example longitudinal section of the example embodiment depicted in FIG. 7.

Further mechanisms to lock the slider supports in the fully extended or fully retracted positions used in some embodiments. FIG. 7 indicates the location of longitudinal section A-A and cross-section C-C on an example, triple-panel embodiment of the present invention in the closed position, which is described more fully in the following figures. FIG. 8 depicts the location of detail B on the longitudinal section A-A.

Figure 9:
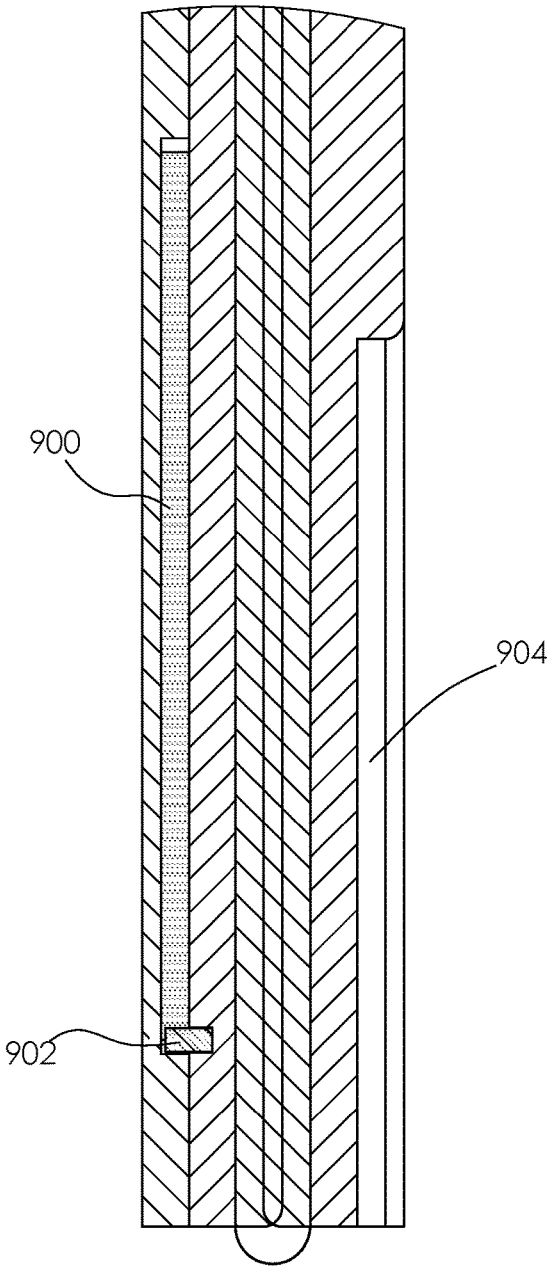
FIG. 9 is a detailed view of the example longitudinal section depicted in FIG. 8.

FIG. 9 illustrates detail B on the longitudinal section A-A of the example, triple-panel embodiment of the present invention in the closed position as depicted in FIG. 8. To lock the slider supports in the fully extended or fully retracted positions used in some embodiments, slot 900 extends through the sliding mechanism. Locking pin 902 is fixed into slot 900, but has, in some embodiments some freedom of movement out and into slot 900. Locking pin 902 can engage in slot 904, when the apparatus is unfolded. This engagement can be such that it allows the sliding support to extend to the desired distance and no farther, when in use.

Figure 10:
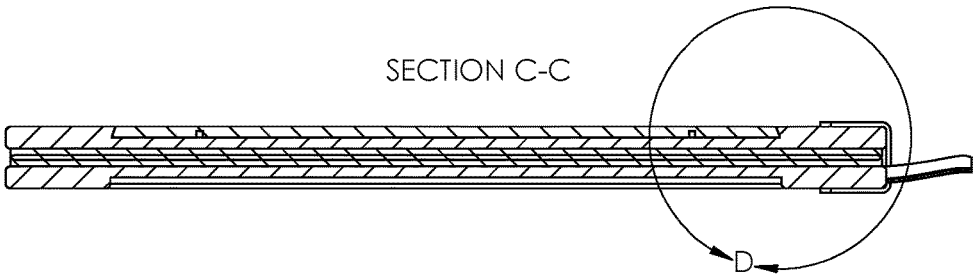
FIG. 10 is an example cross-section of the example embodiment depicted in FIG. 7.
Figure 11:
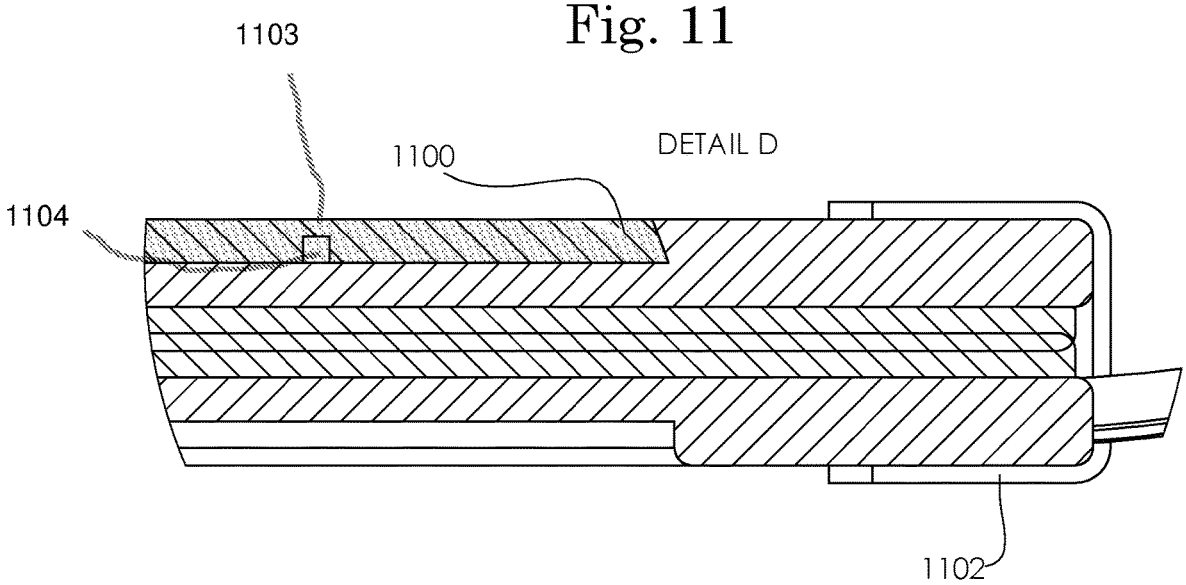
FIG. 11 is a detailed view of the example longitudinal section depicted in FIG. 10.

FIG. 10 depicts the location of detail D on cross-section C-C. FIG. 11 illustrates detail D of the example, triple-panel embodiment of the present invention in the folded position as depicted in FIG. 10. Sliding support 1100 is configured to have a groove 1103 that rides on a dovetail 1104 on the panel to control the movement of the sliding support 1100. One or more clips 1102 may be placed over one side of the folded apparatus to hold it shut. Preferably clip 1102 is placed opposite the hinge for more secure fastening. Those of skill in the art will recognize other methods of holding the apparatus of the present invention shut, such as magnets, buttons and straps, Velcro, and the like.

Dimensions/General Specifications

Most preferred embodiments of the exercise apparatus of the present invention have an overall width between 18" (45.5 cm) and 28" (71.1 cm) wide, with an overall length that is designed to fit patients' needs and specifications, most preferred between 46" (116.8 cm) and 80" (203.2 cm). The thickness of the exercise apparatus depends largely on the amount and placement of the padding desired.

While the embodiments of the present invention may comprise any material with a suitable strength to support the weight of a user, embodiments of the present invention seek to minimize the weight of the apparatus to increase portability. For example, the weight of the apparatus will be 25 lbs. (11.3 kg) or less, 20 lbs. (9.1 kg) or less, 14 lbs. (6.3 kg) or less, 10 lbs. or less (4.5 kg). It may also be noted that the product weight could increase depending on features and construction materials. Embodiments of the present invention may be padded or unpadded depending on the therapeutic needs. Padding thicknesses may vary depending on user needs. Various double- and triple-panel embodiments of the present invention may be constructed of high strength to weight materials such as wood, plastic and/or metals such as aluminum of This product is not limited to any particular number of support panels or hinge configurations: the intent is to provide a supportive and lightweight surface for exercise and recovery.

Methods of Manufacture and Use

Aspects of the present invention include methods of manufacture and use of the present invention. Some aspects of the present invention include a method of manufacture of a portable exercise platform, comprising assembling two, three or more panels where the two, three or more panels are connected at one end by at least one hinging device allowing these panels to lay flat or fold into proximity to each other and these panels are configured with a top and bottom surface such that the top surface is designed to support a user and the bottom surface is designed to contact the substrate when the platform is lying flat, as well as other embodiments described within or known to persons of skill in the art.

Other aspects of the present invention may include a method of using a portable exercise platform comprising two, three or more panels where the two, three or more panels are connected at one end by at least one hinging device allowing these panels to lay flat or fold into proximity to each other and these panels are configured with a top and bottom surface such that the top surface is designed to support a user and the bottom surface is designed to contact the substrate when the platform is lying flat, as well as other embodiments described within or known to persons of skill in the art, comprising unfolding the platform to lie flat, and/or placing the platform on a surface prior to exercise, and/or folding the platform such that said two or more panels are in close proximity to each other.

What is claimed is:

1. A portable exercise platform allowing a user to sit on or lay supine during exercise on a soft substrate, the portable exercise platform comprising:

at least three panels respectively connected by at least one hinging device allowing said at least three panels to fold into proximity to each other in a folded orientation and in a flat and unfolded orientation lay flat in relation to each other on said soft substrate and remain flat and stable when said user is using said portable exercise platform placed on said soft substrate;

wherein said at least three panels comprises at least two outer panels and at least one central panel, each of said at least two outer panels comprising a sliding support slidable back and forth along a longitudinal axis of the portable exercise platform, the sliding support engaged with a corresponding recess that extends over said at least one central panel and prevents folding of said at least three panels when said portable exercise platform is lying flat and in use; and wherein said portable exercise platform weighs less than 25 pounds.

2. The portable exercise platform of claim 1, wherein a top surface of at least one of said at least three panels further comprises padding, upholstery or both.

3. The portable exercise platform of claim 1, wherein a bottom surface of at least one of said at least three panels is textured to avoid movement over said soft substrate when said portable exercise platform is lying flat and in use.

4. The portable exercise platform of claim 1, further comprising at least one handle attached to at least one of said at least three panels.

5. The portable exercise platform of claim 1, wherein at least one of said at least three panels further comprises a hole configured to serve as a handle.

6. The portable exercise platform of claim 1, wherein the at least one hinging device comprises at least two hinging devices.

7. The portable exercise platform of claim 1, further comprising a locking pin corresponding to each sliding support to prevent the sliding support from over-extension.

8. The portable exercise platform of claim 1, wherein the at least one hinging device is covered with padding and/or upholstery to protect and add comfort to the user while said portable exercise platform is in use.

9. The portable exercise platform of claim 1, wherein said portable exercise platform weighs less than 10 lbs.

10. The portable exercise platform of claim 9 wherein said portable exercise platform is less than 28 inches wide.

11. The portable exercise platform of claim 9 wherein said portable exercise platform is less than 80 inches in length in said flat and unfolded orientation.

* * * * *